US010761471B2

(12) United States Patent
Ishida

(10) Patent No.: US 10,761,471 B2
(45) Date of Patent: Sep. 1, 2020

(54) IMAGE FORMING APPARATUS THAT REMOVES RESIDUAL CHARGES ON IMAGE CARRIER

(71) Applicant: TOSHIBA TEC KABUSHIKI KAISHA, Tokyo (JP)

(72) Inventor: Kazufumi Ishida, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/535,388

(22) Filed: Aug. 8, 2019

(65) Prior Publication Data

US 2020/0064770 A1 Feb. 27, 2020

(30) Foreign Application Priority Data

Aug. 24, 2018 (JP) ..... 2018-157156

(51) Int. Cl.
*G03G 21/08* (2006.01)
*G03G 15/16* (2006.01)

(52) U.S. Cl.
CPC ..... *G03G 21/08* (2013.01); *G03G 15/161* (2013.01); *G03G 15/166* (2013.01); *G03G 2215/00679* (2013.01)

(58) Field of Classification Search
None
See application file for complete search history.

(56) References Cited

U.S. PATENT DOCUMENTS

| | | | | |
|---|---|---|---|---|
| 9,778,612 | B2 | 10/2017 | Ohmura et al. | |
| 9,927,730 | B2 | 3/2018 | Tokudome et al. | |
| 2011/0096452 | A1* | 4/2011 | Miyaji ..... | G03G 21/08 361/212 |

FOREIGN PATENT DOCUMENTS

| | | | |
|---|---|---|---|
| JP | 2002-296990 | A | 10/2002 |
| JP | 2016-133782 | A | 7/2016 |
| JP | 2016-164605 | A | 9/2016 |

OTHER PUBLICATIONS

Extended European Search Report dated Jan. 24, 2020, filed in counterpart European Patent Application No. 19192228.5, 22 pages.

* cited by examiner

*Primary Examiner* — Victor Verbitsky
(74) *Attorney, Agent, or Firm* — Kim & Stewart LLP

(57) ABSTRACT

An image forming apparatus includes an image carrier, a transfer member, and a light source. The image carrier has a photoconductive layer on a surface of the image carrier. The transfer member is configured to cause a toner image formed on the surface of the image carrier to be transferred to a transferee member at a transfer position of the image carrier. The light source is configured to emit light toward the surface of the image carrier after transfer of the toner image to remove residual charges on the photoconductive layer. An effective light receiving width of the image carrier in a width direction thereof is less than a width of the transfer member.

18 Claims, 4 Drawing Sheets

IMAGE FORMING APPARATUS THAT REMOVES RESIDUAL CHARGES ON IMAGE CARRIER

CROSS-REFERENCE TO RELATED APPLICATION

This application is based upon and claims the benefit of priority from Japanese Patent Application No. 2018-157156, filed on Aug. 24, 2018, the entire contents of which are incorporated herein by reference.

FIELD

Embodiments described herein relate generally to an image forming apparatus.

BACKGROUND

An image forming apparatus develops an electrostatic latent image that has been formed on a photoconductive drum by using toner. After a toner image is transferred onto an intermediate transfer belt, the charge on the photoconductive drum is removed. If a light used in removing the photoconductive drum charge leaks to an upstream side of a toner image transfer position, image defects may result.

An image forming apparatus that can suppress image defects is desirable.

DETAILED DESCRIPTION

According to an embodiment, an image forming apparatus includes an image carrier, a transfer member, and a light source. The image carrier has a photoconductive layer on a surface of the image carrier. The transfer member is configured to cause a toner image formed on the surface of the image carrier to be transferred to a transferee member at a transfer position of the image carrier. The light source is configured to emit light toward the surface of the image carrier after transfer of the toner image to remove residual charges on the photoconductive layer. An effective light receiving width of the image carrier in a width direction thereof is less than a width of the transfer member.

Hereinafter, an image forming apparatus of an example embodiment is described with reference to the accompanying drawings.

In the present application, an X direction, a Y direction, and a Z direction are defined for explanatory convenience. The Y direction is a width direction parallel to a rotational axis of the photoconductive drum. The Z direction is a generally vertical direction. The X direction is a generally horizontal direction and is orthogonal to the Y and Z directions.

Figure 1:
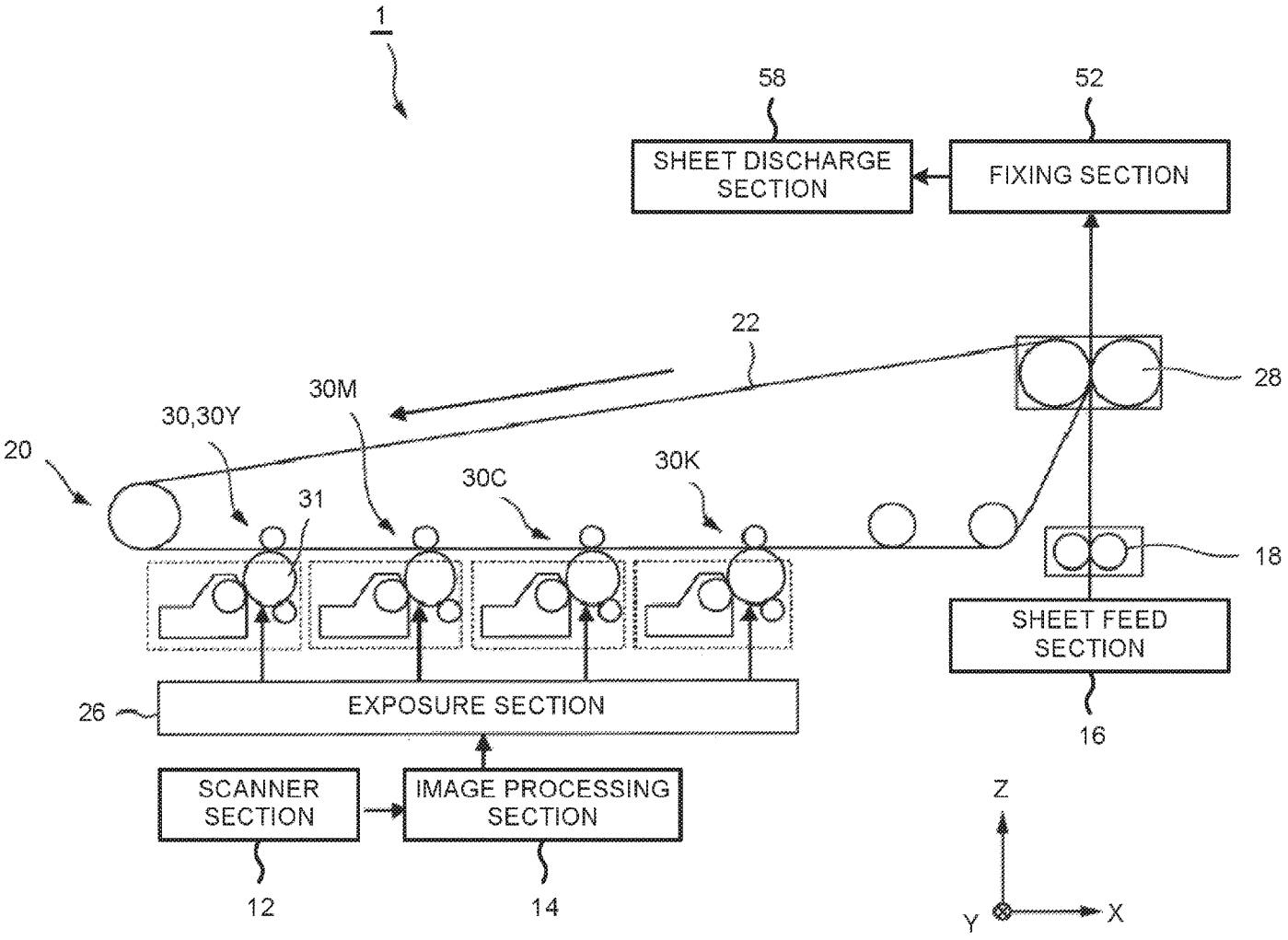
FIG. 1 is a diagram schematically illustrating a configuration of an image forming apparatus according to an embodiment.

FIG. 1 is a diagram schematically illustrating a configuration of an image forming apparatus according to the embodiment. The image forming apparatus 1 includes a scanner section 12, an image processing section 14, a sheet feed section 16, a registration roller 18, a printing section 20, a fixing section 52 and a sheet discharge section 58.

The scanner section 12 scans an image that has been formed on a sheet. For example, the scanner section 12 scans an image on a sheet to generate image data of three component colors including red (R), green (G), and blue (B). The scanner section 12 outputs the generated image data to the image processing section 14.

The image processing section 14 converts the image data to color signals for respective colors. For example, the image processing section 14 converts the image data to color signals for four colors including yellow (Y), magenta (M), cyan (C), and black (K). The image processing section 14 controls an exposure section 26 based on the color signals for respective colors.

The printing section 20 forms an output image (hereinafter, referred to as a toner image) with toner (developer) based on the image data received from the image processing section 14. The printing section 20 transfers the toner image onto a surface of a sheet. The details of the printing section 20 are described below.

The sheet feed section 16 supplies sheets to the registration roller 18 one by one in accordance with a timing at which the printing section 20 forms the toner image.

The registration roller 18 aligns a position of a leading end of the sheet in a conveyance direction of the sheet by adjusting the sheet at a nip. The registration roller 18 conveys the sheet in accordance with a timing at which the printing section 20 transfers the toner image onto the sheet.

The fixing section 52 applies heat and pressure to the sheets to fix the transferred toner image to each sheet. The fixing section 52 discharges the sheets to the sheet discharge section 58.

The sheet discharge section 58 is used to store the discharged sheet(s). For example, the sheet discharge section 58 is a sheet discharge tray.

The printing section 20 includes an image forming section 30, an intermediate transfer belt 22, and a transfer section 28.

The image forming section 30 has a photoconductive drum 31. The image forming section 30 forms a toner image corresponding to the image data on the photoconductive drum 31. Along the intermediate transfer belt 22, a plurality of image forming sections 30Y, 30M, 30C, and 30K is arranged. The plurality of the image forming sections 30Y, 30M, 30C, and 30K forms toner images with yellow toner, magenta toner, cyan toner, and black toner, respectively. Each image forming section 30 first transfers the toner image from the photoconductive drum 31 to the intermediate transfer belt 22. Details of the image forming section 30 are described below.

The toner image on the surface of the photoconductive drum 31 is first transferred onto the intermediate transfer belt 22.

The transfer section 28 transfers the toner image from the intermediate transfer belt 22 to the surface of the sheet at a secondary transfer position.

Figure 2:
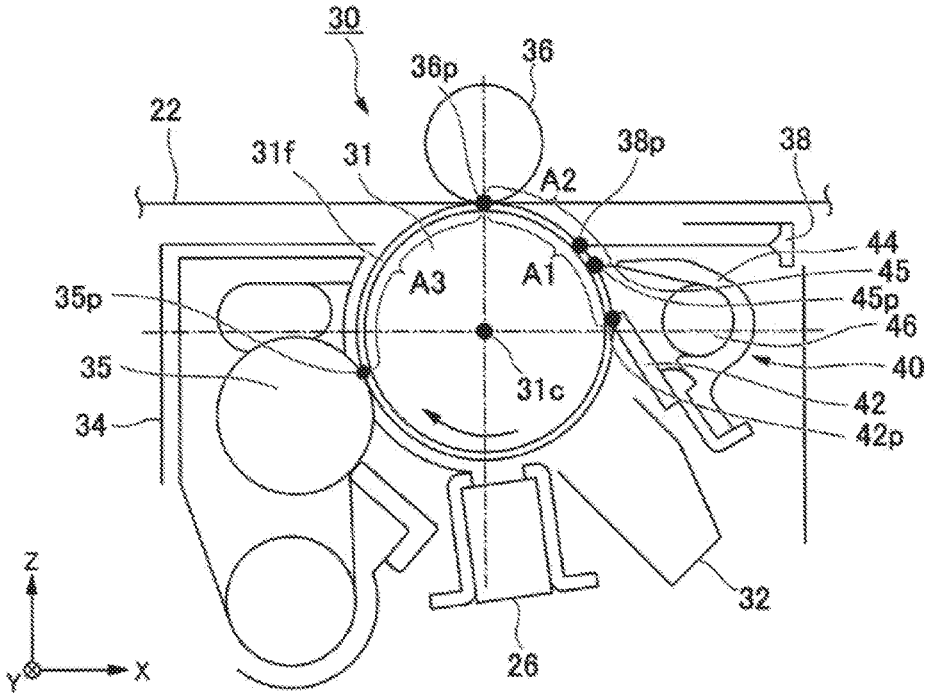
FIG. 2 is a diagram schematically illustrating a configuration of an image forming section.

FIG. 2 is a diagram schematically illustrating a configuration of an image forming section 30. The image forming section 30 includes the photoconductive drum 31 (also referred to as an image carrier 31), a charging member 32, an exposure section 26, a developing mechanism 34, a transfer member 36, a charge removing member 38, and a cleaning mechanism 40. The components of the image forming section 30 are provided in plane symmetrical manner with respect to an XZ plane passing through the center of the photoconductive drum 31 in the Y direction.

The photoconductive drum 31 carries an electrostatic latent image. The photoconductive drum 31 has a cylindrical shape. The photoconductive drum 31 can rotate around a rotation axis 31*c*. A photoconductive layer 31*f* is formed on an outer peripheral surface of the photoconductive drum 31. The photoconductive layer 31*f* is an optical semiconductor material or the like. In this context, the optical semiconductor material has a property of retaining static electricity in a dark (unexposed) place (i.e., a place at which no light has been applied) and releasing the static electricity in portions irradiated with light. In other words, in the photoconductive layer 31*f*, the static electrical charge is removed in those portions irradiated with light.

The charging member 32 performs a charging process to charge the surface of the photoconductive drum 31. The charging member 32 has a discharge source such as a wire or a needle. If a high voltage is applied to the discharge source, the discharge source performs corona discharge. In this way, a charge moves to the surface of the photoconductive drum 31. For example, the charging member 32 charges the surface of the photoconductive drum 31 with negative charge. In other examples, the charging member 32 may charge the surface of the photoconductive drum 31 with a roller, a brush, or the like.

The exposure section 26 performs an exposure process including scanning and exposing the surface of the photoconductive drum 31 based on the image data received from the image processing section 14. The exposure section 26 has a scanning optical system. The scanning optical system includes a light source, a polygon mirror, and the like. For example, the light source is a laser light source or an LED (Light Emitting Diode) light source. The polygon mirror reflects the light emitted from the light source while rotating. In this way, the exposure section 26 scans and exposes the surface of the photoconductive drum 31. The negative charge in the exposed portions of the surface of the photoconductive drum 31 is removed. In this way, an electrostatic latent image based on the image data is formed on the surface of the photoconductive drum 31.

The developing mechanism 34 performs a developing process of attaching the toner to the photoconductive drum 31 to develop the electrostatic latent image. The developing mechanism 34 contains toner and carrier. The developing mechanism 34 has a developing member 35 for feeding the toner to the photoconductive drum 31. A longitudinal direction of the developing member 35 is parallel to the Y direction. The developing member 35 has a width (third width) W35 in the Y direction (refer to FIG. 6). For example, the developing member 35 is a developing roller having a cylindrical sleeve and a magnet roller arranged at the inner side of the sleeve. The sleeve rotates around the magnet roller in a state in which the toner and the carrier adhere to the outer peripheral surface of the sleeve. The toner is negatively charged. In a portion of the photoconductive drum 31 where the latent electrostatic image is formed, the negative charge is removed. The other portion of the photoconductive drum 31 still has the negative charge. Therefore, the toner is attached only to the portion of the photoconductive drum 31 where the latent electrostatic image is formed by electrostatic force. The electrostatic latent image on the photoconductive drum 31 is developed with the toner to form a toner image on the surface of the photoconductive drum 31. In the photoconductive drum 31, a position at which a distance to the developing member 35 is shortest is a developing position 35*p* in a circumferential direction of the photoconductive drum 31 (hereinafter, simply referred to as a developing position). The developing member 35 performs the developing process at the developing position 35*p*.

The transfer member 36 performs a transfer process for transferring the toner image on the photoconductive drum 31 onto the intermediate transfer belt 22. The intermediate transfer belt 22 is an example of a transferee member. A longitudinal direction of the transfer member 36 is parallel to the Y direction. The transfer member 36 has a width (second width) W36 in the Y direction (refer to FIG. 6). For example, the transfer member 36 is a transfer roller. The transfer member 36 is arranged to face the photoconductive drum 31 across the intermediate transfer belt 22. The transfer member 36 presses the intermediate transfer belt 22 against the photoconductive drum 31. The transfer member 36 causes the intermediate transfer belt 22 to contact the photoconductive drum 31. The transfer member 36 applies a high voltage to charge the intermediate transfer belt 22 with a positive charge. The toner negatively charged is attached to the intermediate transfer belt 22 by the electrostatic force. Thereby, the toner image on the photoconductive drum 31 is transferred onto the intermediate transfer belt 22. A contact position of the intermediate transfer belt 22 with the photoconductive drum 31 is a transfer position 36*p* in the circumferential direction of the photoconductive drum 31. The transfer member 36 performs the transfer process at the transfer position 36*p*.

The charge removing member 38 performs a charge removing process for removing the charge remaining on the surface of the photoconductive drum 31. A longitudinal direction of the charge removing member 38 is parallel to the Y direction. The charge removing member 38 has a width W38 in the Y direction (refer to FIG. 6). For example, the charge removing member 38 include a plurality of LED light sources arranged in the Y direction. The charge removing member 38 emits light towards the photoconductive layer 31*f* on the surface of the photoconductive drum 31. The charge removing member 38 lowers an electrical resistance of the photoconductive layer 31*f* to remove the charge on the surface by neutralization. The charge remaining on the surface of the photoconductive drum 31 is removed through the light emitted from the charge removing member (hereinafter, referred to as charge removing light). The charge removing member 38 keeps a surface potential of the photoconductive layer 31*f* constant before the charging process. In this way, the surface of the photoconductive drum 31 is uniformly charged in the charging process. A position at which the charge removing light is incident on the photoconductive drum 31 is a charge removing position 38*p* in the circumferential direction of the photoconductive drum 31 (hereinafter, simply referred to as a charge removing position). The charge removing member 38 performs the charge removing process at the charge removing position 38*p*.

The cleaning mechanism 40 performs a cleaning process for removing the toner remaining on the surface of the photoconductive drum 31. The cleaning mechanism 40 has a blade 42 as a cleaning member, a cover 44, an auger 46, and a sealing member 45.

The blade 42 scrapes the toner remaining on the surface of the photoconductive drum 31 to remove the toner. The blade 42 is made of a rubber material or the like. A leading end of the blade 42 abuts against the surface of the photoconductive drum 31. The position where the blade 42 abuts against the photoconductive drum 31 is referred to as a cleaning position 42*p* in the circumferential direction of the photoconductive drum 31. The blade 42 performs a cleaning process at the cleaning position 42*p* of the photoconductive drum 31.

The cover 44 prevents the scraped toner from scattering.

The auger 46 recovers the scraped toner and conveys it to a waste toner container.

The sealing member 45 seals a space between the cover 44 and the photoconductive drum 31. The sealing member 45 prevents the scraped toner from flowing out from the space between the cover 44 and the photoconductive drum 31. The sealing member 45 is made of a polymer film or urethane foam. The leading end of the sealing member 45 contacts the surface of the photoconductive drum 31. The position where the sealing member 45 contacts the photoconductive drum 31 is a sealing position 45*p* in the circumferential direction of the photoconductive drum 31. The sealing member 45 prevents the toner removed by the blade 42 from scattering at the sealing position 45*p*.

The image forming section 30 repeatedly performs the charging process, the exposure process, the developing process, the transfer process, the charge removing process, and the cleaning process described above in this order. In this way, the image forming section 30 forms a toner image on the surface of the photoconductive drum 31. The image forming section 30 transfers the toner image on the photoconductive drum 31 onto the intermediate transfer belt 22.

The charge removing position and the charge removing effect are described.

Figure 3:
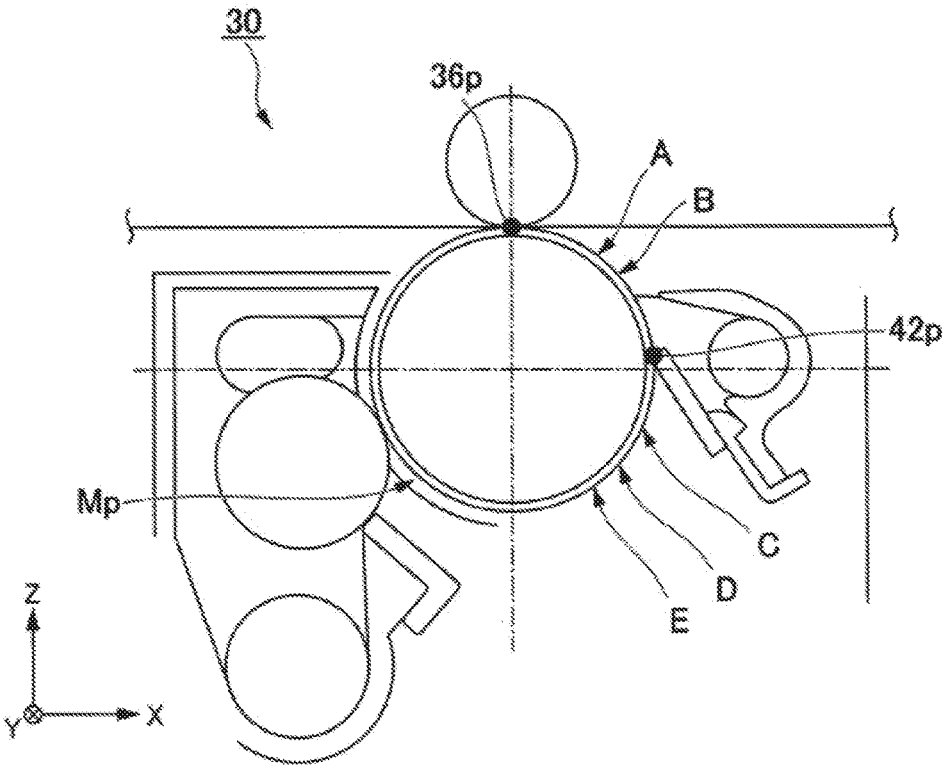
FIG. 3 is a diagram illustrating a charge removing position.

FIG. 3 is a diagram illustrating the charge removing position.

For example, A to E shown in FIG. 3 are considered as charge removing positions 38*p*. The charge removing positions A and B are positions on an upstream side in a rotation direction of the photoconductive drum 31 (hereinafter, simply referred to as an upstream side) with respect to the cleaning position 42*p*. The charge removing positions A and B are between the transfer position 36*p* and the cleaning position 42*p*. The charge removing positions C to E are positions on a downstream side in the rotation direction of the photoconductive drum 31 (hereinafter, simply referred to as a downstream side) with respect to the cleaning position 42*p*.

The charge removing effect by the charge removing member 38 is evaluated by the charge remaining on the surface of the photoconductive drum 31 after charge removing. The photoconductive drum 31 contacts the intermediate transfer belt 22 which is positively charged in the transfer process. Therefore, the surface of the photoconductive drum 31 after the transfer process can be affected by this positive charge. As a result, it may become difficult to negatively charge the surface of the photoconductive drum 31 in the subsequent charging process. Therefore, in the charge removing process between the transfer process and the charging process, it is desirable to remove the positive charge as well as any negative charge. In other words, it is desirable that an amount of the positive charge remaining on the surface of the photoconductive drum 31 after charge removal processing is small. It is desirable that a positive potential of the surface of the photoconductive drum 31 after charge removing is small. The electric potential of the surface of the photoconductive drum 31 after charge removal is measured at a position Mp on the upstream side of the developing member 35. For a state in which the charging member 32 and the exposure section 26 have been removed, the potential after charge removing is measured.

Figure 4:
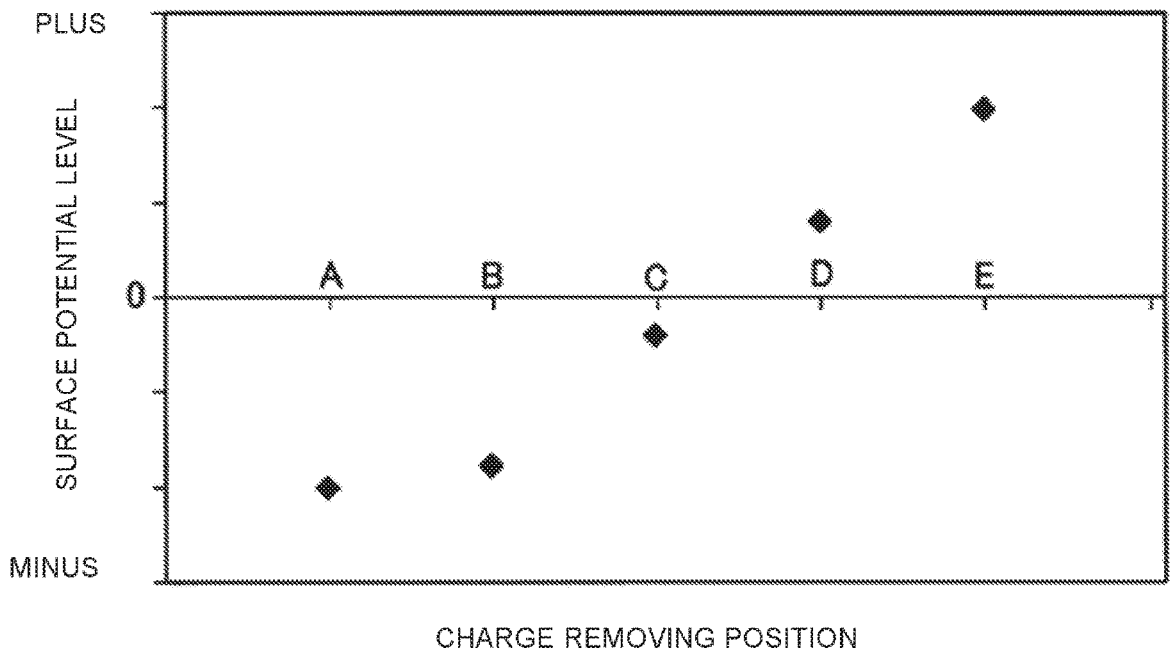
FIG. 4 is a diagram illustrating a charge removing effect at the charge removing position.

FIG. 4 is a diagram illustrating the charge removing effect.

As shown in FIG. 4, in the case of the charge removing positions E and D, the potential is the positive potential, and the positive charge remains. In the case of the charge removing position C, the potential is almost zero, and the positive charge has been removed. In the case of the charge removing positions B and A, the potential is the negative potential. In other words, the positive charge has been removed, and the surface of the photoconductive drum 31 has been furthermore negatively charged. According to this result, it can be understood that the charge removing effect becomes higher as the charge removing position 38*p* is positioned further on the upstream side. It is considered in this context that the surface charge is naturally neutralized as time goes by after charge removal processing.

Based on the result of FIG. 4, the charge removing position 38*p* is set in a first area A1 (see FIG. 2) between the transfer position 36*p* and the cleaning position 42*p*. In this way, the charge remaining on the surface of the photoconductive drum 31 can be sufficiently removed. Before the charging process, the surface potential of the photoconductive layer 31*f* is thus kept constant.

The charge removing member 38 is arranged on the outer side of the cleaning mechanism 40. In the case in which the charge removing position 38*p* is set between the sealing position 45*p* and the cleaning position 42*p*, it is difficult for the charge removing light to be incident at the particular charge removing position 38*p* from the charge removing member 38. Therefore, it is desirable that the charge removing position 38*p* is arranged in a second area A2 (see FIG. 2) between the transfer position 36*p* and the sealing position 45*p*. Thereby, even when the charge removing member 38 is arranged on the outer side of the cleaning mechanism 40, the charge removing light from the charge removing member 38 can be incident at the charge removing position 38*p*.

A wraparound action of the charge removing light is described.

The charge removing light emitted from the charge removing member 38 spreads while travelling. Therefore, a part of the charge removing light may act on a third area A3 (see FIG. 2) between the developing position 35*p* and the transfer position 36*p*. However, in the third area A3, on the surface of the photoconductive drum 31, there is an image forming portion on which a toner image is formed. In the third area A3, a non-image forming portion other than the image forming portion is negatively charged. If the charge removing light acts on this non-image forming portion, the negative charge thereof is removed. Thus, the toner might jump out from the image forming portion to the non-image forming portion. As a result, image defects may occur.

As described above, the charge removing position 38*p* is arranged in the first area A1. The charge removing position 38*p* in this case is thus potentially close to the third area A3. Therefore, the charge removing light tends to act on the third area A3. The transfer member 36 causes the intermediate transfer belt 22 to contact the photoconductive drum 31. There is no gap between the intermediate transfer belt 22 and the photoconductive drum 31 at the inner side of the transfer member 36 in the Y direction. On the outer side of the transfer member 36 in the Y direction, a gap is formed between the intermediate transfer belt 22 and the photoconductive drum 31. The charge removing light penetrates this gap, travels around the outer side of the transfer member 36 in the Y direction, and acts on the third area A3. As a result, image defects occur in an end area of an image forming area in the Y direction.

Figure 5:
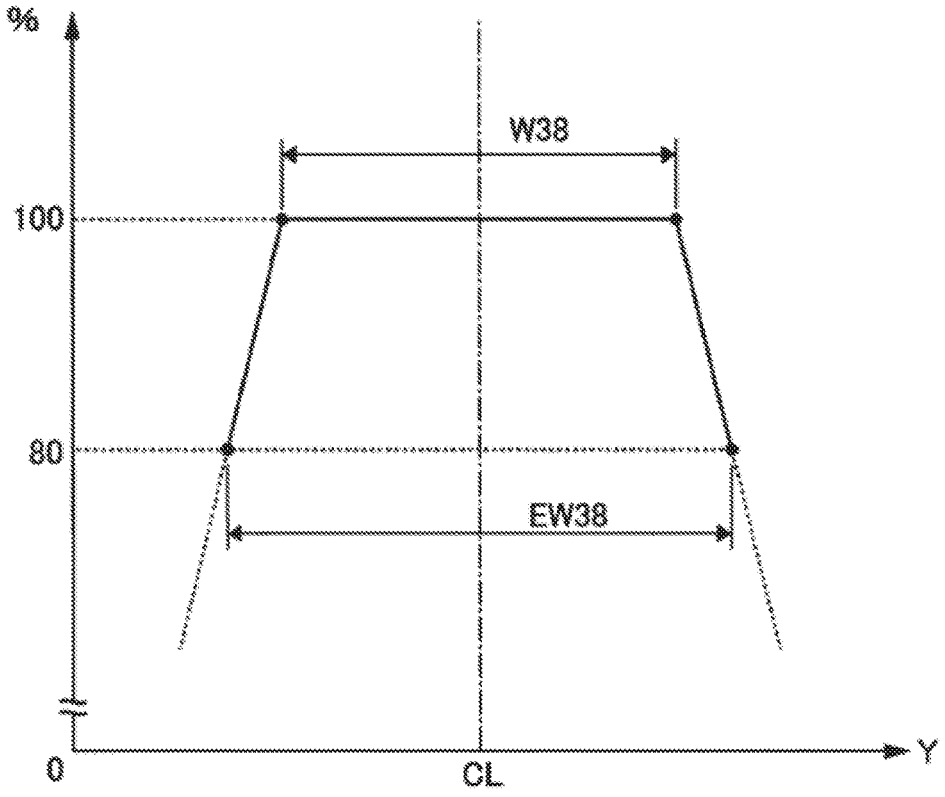
FIG. 5 is a diagram illustrating an effective light receiving width of charge removing light.

FIG. 5 is a diagram illustrating an effective light receiving width for the charge removing light. The horizontal axis in FIG. 5 is a position in the Y direction at the charge removing position 38*p* in the circumferential direction of the photoconductive drum 31. CL in FIG. 5 refers to a center of the photoconductive drum 31 in the Y direction (width direction). A vertical axis in FIG. 5 is a light receiving amount (%) at each position in the Y direction when the maximum light receiving amount of the charge removing light at the charge removing position 38*p* is 100%.

The charge removing member 38 is formed in plane symmetry manner with respect to an XZ plane including the center CL. The width of the charge removing member 38 in the Y direction is W38. At the charge removing position 38*p*, in an area corresponding to the width W38 of the charge removing member 38, the light receiving amount of the charge removing light reaches the maximum light receiving amount (100%). The charge removing light emitted from the charge removing member 38 travels while spreading. At the charge removing position 38*p*, in an area on the outer side of the charge removing member 38 in the Y direction, the light receiving amount is smaller than the maximum light receiving amount. The light receiving amount decreases further towards the outer side of the charge removing member 38 in the Y direction. As a result of the experiment, it is found that the image is not adversely affected in the area where the light receiving amount is less than 80% of the maximum light receiving amount. It is considered that if the light receiving amount is less than 80% of the maximum light receiving amount, the charge removing effect is small and the toner does not jump out. In contrast, in an area in which the light receiving amount is 80% or more of the maximum light receiving amount, a sufficient charge removing effect can be achieved. At the charge removing position 38*p*, the width at which the light receiving amount of charge removing light is 80% or more of the maximum light receiving amount is referred to as an effective light receiving width (first width) EW38. The effective light receiving width EW38 is larger than the width W38 of the charge removing member 38. The charge removing member 38 removes the charge of the photoconductive drum 31 at the effective light receiving width EW38 at the charge removing position 38*p*.

Figure 6:
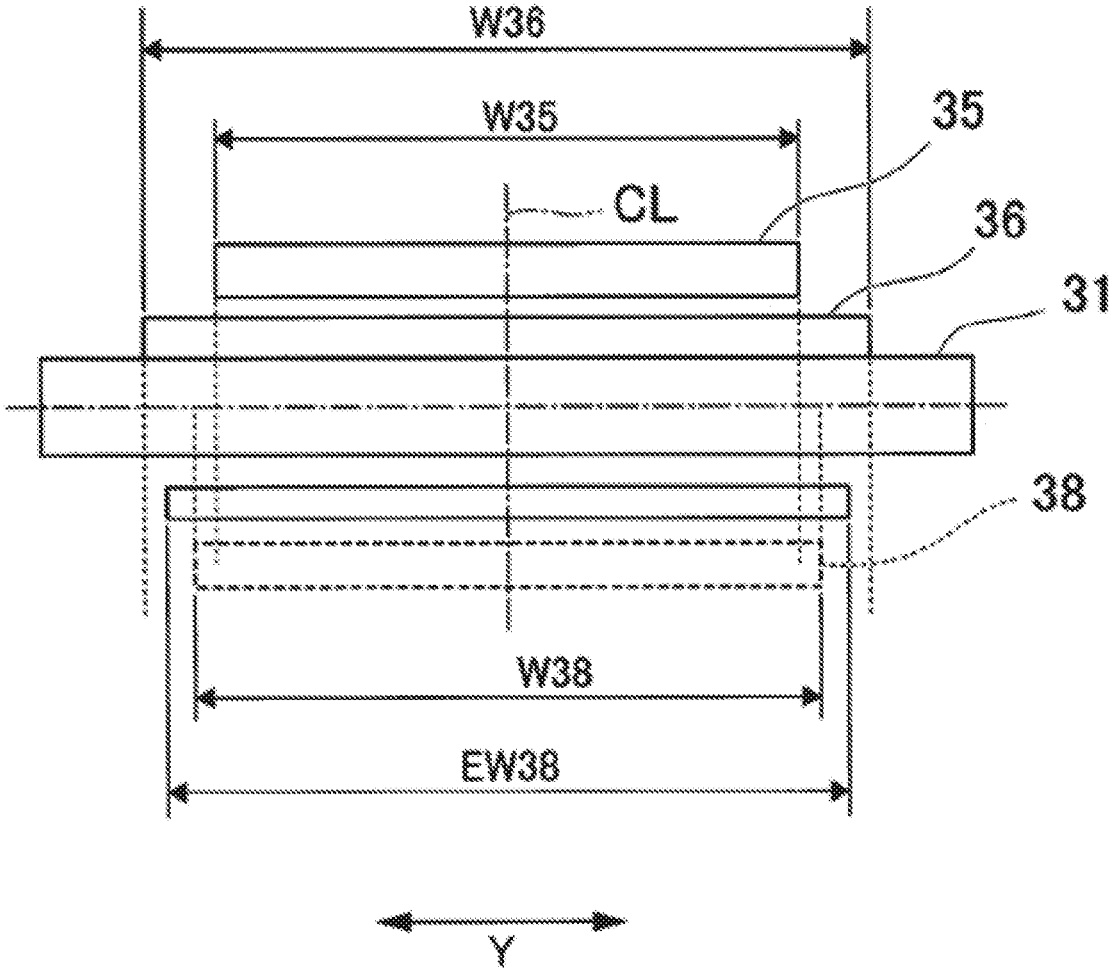
FIG. 6 is a diagram illustrating comparison of width dimensions among respective portions of the image forming section.

FIG. 6 is a diagram illustrating comparison of the width dimensions of respective portions of the image forming section. CL in FIG. 6 is the center of the photoconductive drum 31 in the Y direction (width direction).

The width (second width) W36 of the transfer member 36 in the Y direction is larger than the effective light receiving width EW38. In this way, the charge removing light emitted to the inner side of the effective light receiving width EW38 (hereinafter, referred to as inner charge removing light) is blocked by the intermediate transfer belt 22 pressed towards the photoconductive drum 31 by the transfer member 36. The inner charge removing light does not act on the third area A3 of the photoconductive drum 31. Therefore, the charge in the third area A3 is not removed by the inner charge removing light, and the toner does not jump out. On the other hand, the charge removing light emitted to the outer side of the effective light receiving width EW38 (hereinafter, referred to as an outer charge removing light) penetrates the gap between the intermediate transfer belt 22 and the photoconductive drum 31 on the outer side of the transfer member 36 in the Y direction. The outer charge removing light may act on the third area A3 of the photoconductive drum 31. Even in this case, only the outer charge removing light having a small charge removing effect acts on the third area A3. Therefore, the charge in the third area A3 is not removed by the outer charge removing light, and the toner does not jump out. Thus, the occurrence of image defects can be suppressed.

As shown in FIG. 6, the width (third width) W35 of the developing member 35 in the Y direction is smaller than both the width W36 of the transfer member 36 and the effective light receiving width EW38. In this way, a range in which the toner adheres to the photoconductive drum 31 is restricted. Therefore, image defects can be suppressed.

As described in detail above, the image forming apparatus 1 of the embodiment has the photoconductive drum 31, the charge removing member 38, and the transfer member 36. The photoconductive drum 31 has the photoconductive layer 31*f* in which the charge of a light irradiated area is removed on the surface. The charge removing member 38 irradiates the surface of the photoconductive drum 31 with the light at the charge removing position 38*p* of the photoconductive drum 31. The charge removing member 38 removes the charge of the photoconductive drum 31 in the Y direction at the effective light receiving width EW38. The transfer member 36 has the width W36 in the Y direction. The transfer member 36 transfers the toner attached to the photoconductive drum 31 onto the intermediate transfer belt 22 at the transfer position 36*p* of the photoconductive drum 31. The width W36 of the transfer member 36 is larger than the effective light receiving width EW38.

According to such a configuration, the inner charge removing light emitted to the inner side of the effective light receiving width EW38 is blocked by the intermediate transfer belt 22 pressed towards the photoconductive drum 31 by the transfer member 36. The inner charge removing light does not act on the third area A3 on the upstream side of the transfer member 36. Therefore, the charge in the third area A3 is not removed by the inner charge removing light, and the toner does not jump out. On the other hand, the outer charge removing light emitted to the outer side of the effective light receiving width EW38 penetrates the gap between the intermediate transfer belt 22 and the photoconductive drum 31 on the outer side of the transfer member 36. The outer charge removing light may act on the third area A3 of the photoconductive drum 31. Even in this case, only the outer charge removing light having the small charge removing effect acts on the third area A3. Therefore, the charge in the third area A3 is not removed by the outer charge removing light, and the toner does not jump out. Thus, the occurrence of image defects can be suppressed.

The effective light receiving width EW38 is a width at which the light receiving amount of the surface of the photoconductive drum 31 irradiated by the charge removing member 38 is 80% or more of the maximum light receiving amount.

According to this configuration, the charge removing effect of the outer charge removing light emitted to the outer side of the effective light receiving width EW38 is small. Therefore, the charge in the third area A3 of the photoconductive drum 31 is not removed by the outer charge removing light. Therefore, the occurrence of image defects can be suppressed.

The image forming apparatus 1 has the blade 42 that removes the toner remaining on the photoconductive drum 31 at the cleaning position 42*p* of the photoconductive drum 31. The charge removing position 38*p* is set between the transfer position 36*p* and the cleaning position 42*p*.

According to such a configuration, a sufficient charge removing effect can be achieved before the charging process. However, since the charge removing position 38*p* is close to the third area A3 of the photoconductive drum 31, the charge removing light tends to act on the third area A3. Even in this case, the occurrence of the image defects can be suppressed as described above.

The developing member 35 has the width W35 in the Y direction.

The developing member 35 attaches the toner to the photoconductive drum 31 for developing at the developing position 35*p* of the photoconductive drum 31. The width W35 of the developing member 35 is smaller than the effective light receiving width EW38.

According to such a configuration, the range in which the toner adheres to the photoconductive drum 31 is restricted. Therefore, the occurrence of image defects can be suppressed.

The sealing member 45 prevents the toner removed by the blade 42 from scattering at the sealing position 45*p* between the transfer position 36*p* and the cleaning position 42*p* of the photoconductive drum 31. The charge removing position 38*p* is set between the transfer position 36*p* and the sealing position 45*p*.

According to such a configuration, even when the charge removing member 38 is arranged on the outer side of the cleaning mechanism 40, the charge removing light can be incident at the charge removing position 38*p* from the charge removing member 38.

According to at least one embodiment described above, the transfer member 36 has the width W36 that is larger than the effective light receiving width EW38 of the charge removing light. Thereby, the occurrence of image defects can be suppressed.

While certain embodiments of the present invention have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus, comprising:

an image carrier having a photoconductive layer on a surface thereof;

a transfer member configured to cause a toner image formed on the surface of the image carrier to be transferred to a transferee member at a transfer position of the image carrier;

a light source configured to emit light toward the surface of the image carrier after transfer of the toner image to remove residual charges on the photoconductive layer, an effective light receiving width of the image carrier in a width direction thereof being less than a width of the transfer member; and a cleaning blade configured to remove residual toner on the surface of the image carrier at a cleaning position after the transfer of the toner image, wherein the light emitted from the light source is directed to a position of the image carrier in a region from the transfer position to the cleaning position in a rotational direction of the image carrier.

2. The image forming apparatus according to claim 1, wherein the effective light receiving width is a width of a region of the image carrier at which an intensity of the light received from the light source is equal to or greater than 80% of a maximum intensity of the light on the surface of the image carrier.

3. The image forming apparatus according to claim 2, wherein the region of the image carrier at which the intensity of the light received from the light source is equal to or greater than 80% of the maximum intensity is entirely within a region of the image carrier facing the transfer member in the width direction.

4. The image forming apparatus according to claim 2, wherein a width of a region of the image carrier at which a toner image is formable is less than the effective light receiving width.

5. The image forming apparatus according to claim 4, wherein the region of the image carrier at which the toner image is formable is entirely within the region of the image carrier at which the intensity of the light received from the light source is equal to or greater than 80%.

6. The image forming apparatus according to claim 1, wherein the position of the image carrier to which the light emitted from the light source is directed is closer to the cleaning position than the transfer position.

7. The image forming apparatus according to claim 1, further comprising:

a toner sealing member in contact with the surface of the image carrier at a sealing position between the transfer position and the cleaning position, wherein the position of the image carrier to which the light emitted from the light source is directed is in a region from the transfer position to the sealing position in a rotational direction of the image carrier.

8. The image forming apparatus according to claim 7, wherein the position of the image carrier to which the light emitted from the light source is directed is closer to the sealing position than the transfer position.

9. The image forming apparatus according to claim 1, wherein the light source includes a plurality of LEDs arranged in a width direction thereof.

10. The image forming apparatus according to claim 1, wherein the position of the image carrier to which the light emitted from the light source is directed is closer to the transfer position than a developing position of the image carrier at which the toner image is formed on the surface of the image carrier.

11. An image forming method, comprising:

forming a toner image on a surface of an image carrier having a photoconductive layer on a surface thereof;

transferring the toner image to a transferee member at a transfer position of the image carrier pressed by a transfer member;

irradiating the surface of the image carrier with light after transfer of the toner image to remove residual charges on the photoconductive layer, an effective light receiving width of the image carrier in a width direction thereof being less than a width of the transfer member; and removing residual toner on the surface of the image carrier at a cleaning position after the transfer of the toner image, wherein the light is directed to a position of the image carrier in a region from the transfer position to the cleaning position in a rotational direction of the image carrier.

12. The image forming method according to claim 11, wherein the effective light receiving width is a width of a region of the image carrier at which an intensity of the light is equal to or greater than 80% of a maximum intensity of the light on the surface of the image carrier.

13. The image forming method according to claim 12, wherein the region of the image carrier at which the intensity of the light is equal to or greater than 80% of the maximum intensity is entirely within a region of the image carrier pressed by the transfer member in the width direction.

14. The image forming method according to claim 12, wherein a width of a region of the image carrier at which a toner image is formable is less than the effective light receiving width.

15. The image forming method according to claim 14, wherein the region of the image carrier at which the toner image is formable is entirely within the region of the image carrier at which the intensity of the light is equal to or greater than 80%.

16. The image forming method according to claim 11, wherein the position of the image carrier to which the light is directed is closer to the cleaning position than the transfer position.

17. The image forming method according to claim 11, further comprising:

sealing the residual toner removed with a toner sealing member in contact with the surface of the image carrier at a sealing position between the transfer position and the cleaning position, wherein the position of the image carrier to which the light is directed is in a region from the transfer position to the sealing position in a rotational direction of the image carrier.

18. The image forming method according to claim 17, wherein the position of the image carrier to which the light is directed is closer to the sealing position than the transfer position.

* * * * *